United States Patent [19]

Beckham et al.

[11] Patent Number: 4,599,683

[45] Date of Patent: Jul. 8, 1986

[54] LANTERN WITH TWO-POSITION GLOBE

[75] Inventors: Hugh C. Beckham; Robert M. Bean, both of Wichita, Kans.

[73] Assignee: The Coleman Company, Inc., Wichita, Kans.

[21] Appl. No.: 623,822

[22] Filed: Jun. 22, 1984

[51] Int. Cl.[4] ..... F21V 3/04

[52] U.S. Cl. ..... 362/166; 362/179; 362/315; 431/311

[58] Field of Search ..... 362/166, 169, 179, 182, 362/186, 246, 355, 363, 167, 171, 178, 180, 312, 315, 351, 356, 360; 431/100, 311, 344; 126/249, 255

[56] References Cited

U.S. PATENT DOCUMENTS

| | | | |
|---|---|---|---|
| Re. 29,457 | 10/1977 | Hastings | 431/123 |
| 612,305 | 10/1898 | Bradford | 362/166 |
| 631,211 | 8/1899 | Hoogerzeil | 362/315 |
| 1,609,277 | 5/1925 | Oliver | 362/363 |
| 2,263,659 | 1/1940 | Tullis | 240/27 |
| 3,529,911 | 5/1968 | Townsend | 431/107 |
| 4,107,768 | 8/1978 | Lemkin | 362/363 |

FOREIGN PATENT DOCUMENTS

| | | | |
|---|---|---|---|
| 601339 | 8/1934 | Fed. Rep. of Germany | 362/363 |

OTHER PUBLICATIONS

1982 Coleman Outing Products Catalog pp. 3, 12, and 13.

*Primary Examiner*—William A. Cuchlinski, Jr.

[57] ABSTRACT

A lantern is provided with a two-position globe which includes a transparent portion and a frosted portion. When the transparent portion is positioned adjacent the light source of the lantern, the lantern provides bright light, and when the frosted portion is positioned adjacent the light source, the lantern provides subdued light.

9 Claims, 5 Drawing Figures

LANTERN WITH TWO-POSITION GLOBE

BACKGROUND AND SUMMARY

This invention relates to lanterns, and, more particularly, to a lantern with a two-position globe.

Fuel-burning lanterns such as gasoline lanterns and propane lanterns conventionally include a light source such as a mantle and a globe which covers the mantle. The globe can be either transparent or translucent, and the light shines through the globe to provide illumination. Typical gasoline lanterns are described in U.S. Pat. Nos. 2,263,659, 3,529,911, and U.S. Pat. No. Re. 29,457.

A transparent globe will not attentuate the light and can be used when bright light is desired. Globes with frosted or translucent portions are available for subduing or dimming the light and/or shielding the mantle from direct view. The prior art includes globes which have frosted portions in various patterns.

Heretofore, the same globe could not be used to provide both bright and subdued light. This is because the lantern mantle is conventionally located midway between the base of the lantern which supports the globe and the top of the lantern which covers the globe. Although a globe with a frosted pattern could be removed from the lantern, turned upside down, and reinserted into the lantern, the frosted pattern would cover the mantle in both positions.

The invention provides a lantern and a two-position globe which has a frosted portion and a transparent portion. The lantern mantle is located above the midpoint between the base and the top. When the globe is positioned so that the frosted portion is on top, the frosted portion covers the mantle and subdues the light. When the transparent portion is on top, the mantle is not covered, and bright light shines through the transparent portion.

DESCRIPTION OF THE DRAWING

The invention will be explained in conjunction with illustrative embodiments shown in the accompanying drawing, in which.

DESCRIPTION OF SPECIFIC EMBODIMENT

Figure 1:
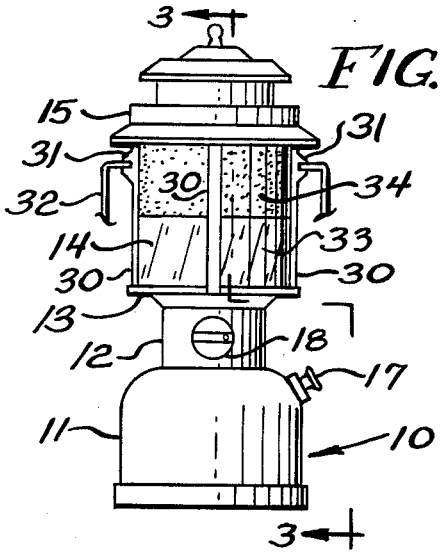
FIG. 1 is an elevational view, partially broken away, of a gasoline lantern equipped with a two-position globe in accordance with the invention.
Figure 2:
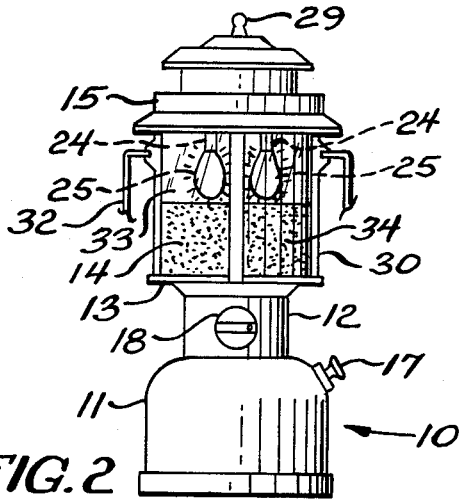
FIG. 2 is a view similar to FIG. 1 showing the globe in the alternate position.
Figure 3:
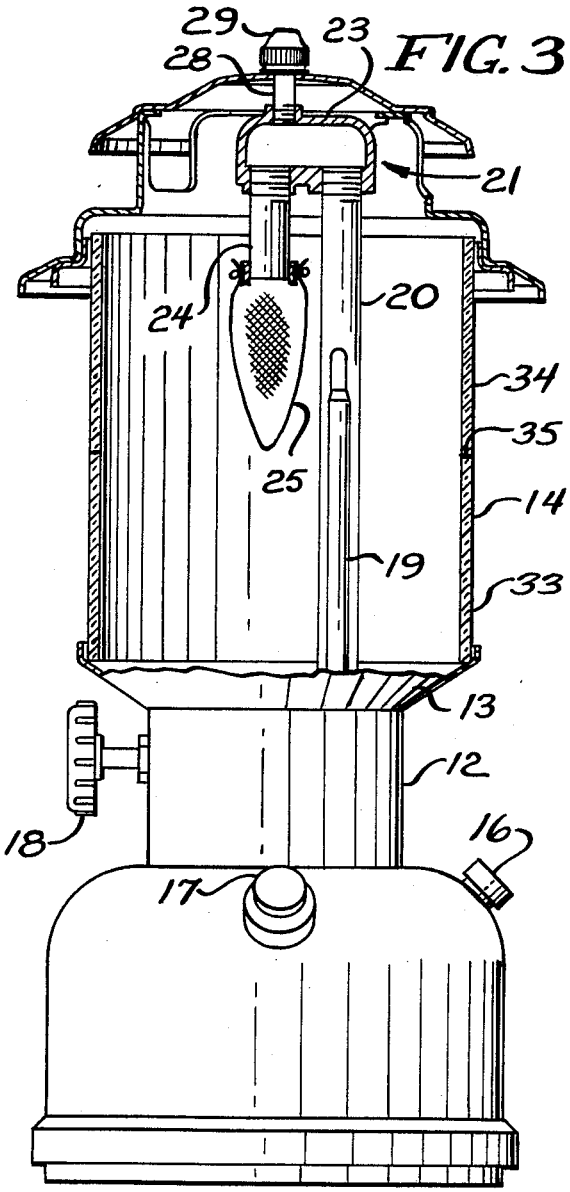
FIG. 3 is an enlarged sectional view taken along the line 3—3 of FIG. 1.

Referring to FIGS. 1–3, a gasoline lantern 10 includes a fount or fuel tank 11, a collar 12 on top of the fount, a base plate 13 above the collar, a cylindrical glass globe 14, and a top 15. The fount is provided with a fill opening which is closed by a cap 16, and the fuel in the fount is pressurized by a hand pump 17.

A fuel control assembly is controlled by a knob 18 and delivers fuel to a generator tube 19 (FIG. 3). The fuel is vaporized in the generator tube and flows into an air tube 20 where it is mixed with combustion air and delivered to burner assembly 21.

The burner assembly 21 includes a manifold 23, a pair of burner tubes 24 which are secured to the manifold, and a pair of mantles 25 which are attached to the burner tubes. A threaded stud 28 is screwed into the top of the manifold, and the top 15 is attached to the stud by a nut 29.

The globe 14 is supported by the base plate 13, and the upper end of the globe is covered by the top 15. A plurality of retaining rods 30 extend upwardly from the base plate outside of the globe, and the upper ends of the rods are connected to a ring which encircles the upper end of the globe. Two diametrically opposed rods includes outwardly extending portions 31, and the ends of a U-shaped handle 32 are secured to the rod portions 31.

With the exception of the globe and the position of the mantles, the foregoing parts are conventional and are described, for example, in U.S. Pat. Nos. 2,263,659, 3,529,911, and U.S. Pat. No. Re. 29,457.

The length of the burner tubes 24 is such that the mantles 25 are supported in the upper half of the space between the base plate 13 and the top 15. The globe 14 includes a clear or transparent portion 33 and a frosted or translucent portion 34. Each of the portions 33 and 34 extend for about half of the axial length of the globe (see FIG. 4), and the boundary 35 between the portions is therefore positioned at about the center line or midpoint between the base plate and the top.

In FIG. 1 the globe is positioned so that the frosted portion 34 is adjacent the top 15. The frosted portion therefore covers the mantles 25, and the light is subdued or dimmed by the frosted portion. The transparent portion 33 is at the bottom, and indirect light from the mantles shines through the transparent portion.

In FIG. 2 the position of the globe is reversed so that the transparent portion 33 is at the top of the globe. The light from the mantles therefore shines directly through the transparent portion, and the lantern provides bright light.

Figure 4:
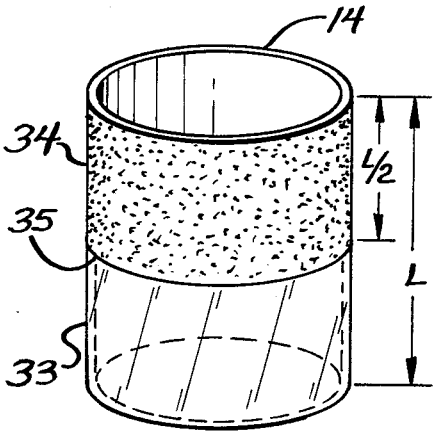
FIG. 4 is an enlarged perspective view of the globe of FIGS. 1–3.
Figure 5:
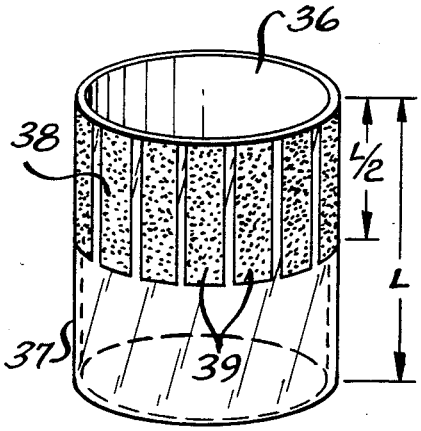
FIG. 5 is a perspective view of another embodiment of the globe.

The frosted or translucent portion 34 of the globe can be provided by any means which attenuates the passage of light, and the term "frosted" as used herein is not meant to be limited to conventional frosted glass. Further, the frosted portion can be solid as illustrated in FIG. 4, or the frosting can be in a pattern as illustrated in FIG. 5. In FIG. 5 the globe 36 includes a transparent portion 37 and a frosted portion 38 which is provided by circumferentially spaced axially extending bands 39 of frosting. Each band extends for half of the length of the globe. Some light can shine through the unfrosted spaces between the bands, and the width of these spaces can be selected to provide the desired amount of illumination.

The position of the globe can be reversed merely by unscrewing the nut 29 and removing the top 15. The globe can then be withdrawn upwardly from between the retaining rods 30, turned upside down, and reinserted into the space between the rods.

FIGS. 1–3 illustrate the mantles positioned above the midpoint of the space between the base plate and the top of the lantern. However, it will be understood that the mantles could also be positioned below the midpoint and still obtain the advantages of the two-position globe.

Although the invention has been described in conjunction with a gasoline lantern, the invention can also be used with other lanterns, for example, propane lanterns.

While in the foregoing specification a detailed description of the invention was set forth for the purpose of illustration, it will be understood that many of the details herein given may be varied considerably by those skilled in the art without departing from the spirit and scope of the invention.

I claim:

1. A one piece globe for a lantern having a light source and means for supporting said globe, the globe having upper and lower halves of substantially equal length, one of the portions being transparent and the other of the portions being frosted.

2. The globe of claim 1 in which the globe is cylindrical.

3. The globe of claim 2 in which each of the portions extend for about one half of the axial length of the globe.

4. A lantern having a base for supporting a globe and a top for covering the globe, a light source between the base and the top, the light source being positioned above or below a centerline halfway between the base and the top, and a one piece globe between the base and the top, the globe having upper and lower portions of substantially equal length, one of the portions being transparent and the other of the portions being frosted, the globe being movable between upright and inverted positions, the transparent portion of the globe covering the light source when the globe is in the upright position and the frosted portion of the globe covering the light source when the globe is in the inverted position whereby the transparent portion of the globe can be positioned adjacent the light source to provide bright light and the frosted portion of the globe can be positioned adjacent the light source to provide subdued light.

5. The lantern of claim 4 in which the globe is cylindrical.

6. The lantern of claim 5 in which each of the portions of the globe extend for about one half of the axial length of the globe.

7. The lantern of claim 4 in which the lantern is a fuel-burning lantern and the light source is a mantle.

8. The lantern of claim 7 in which the mantle is above the midpoint between the base and the top of the lantern.

9. The lantern of claim 8 in which each of the portions of the globe extend for about one half of the axial length of the globe.

* * * * *